US006510706B2

(12) United States Patent
Stone et al.

(10) Patent No.: US 6,510,706 B2
(45) Date of Patent: Jan. 28, 2003

(54) PROCESS FOR NGL RECOVERY FROM PRESSURIZED LIQUID NATURAL GAS

(75) Inventors: John B. Stone, Kingwood, TX (US); Horace G. Winningham, Anderson, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/863,191

(22) Filed: May 23, 2001

(65) Prior Publication Data

US 2002/0029585 A1 Mar. 14, 2002

Related U.S. Application Data

(60) Provisional application No. 60/208,200, filed on May 31, 2000.

(51) Int. Cl.[7] ..... F25J 1/00; F25J 3/02

(52) U.S. Cl. ..... 62/620; 62/611

(58) Field of Search ..... 62/620, 623, 618, 62/619, 611

(56) References Cited

U.S. PATENT DOCUMENTS

| | | | | | |
|---|---|---|---|---|---|
| 2,666,303 | A | | 1/1954 | Schuftan | 62/123 |
| 2,952,984 | A | | 9/1960 | Marshall, Jr. | 62/27 |
| 3,405,530 | A | | 10/1968 | Denahan | 62/28 |
| 3,420,068 | A | * | 1/1969 | Petit et al. | 62/623 |
| 3,446,029 | A | | 5/1969 | Grgurich et al. | 62/52 |
| 3,570,261 | A | | 3/1971 | Schwartzman | 62/53 |
| 3,656,312 | A | | 4/1972 | Streich | 62/28 |
| 3,837,172 | A | * | 9/1974 | Markbreiter et al. | 62/623 |
| 4,009,097 | A | | 2/1977 | Ward | 208/342 |
| 5,114,451 | A | | 5/1992 | Rambo et al. | 62/24 |
| 5,950,453 | A | * | 9/1999 | Bowen et al. | 62/612 |
| 5,956,971 | A | * | 9/1999 | Cole et al. | 62/623 |
| 6,016,665 | A | | 1/2000 | Cole et al. | 62/612 |
| 6,023,942 | A | | 2/2000 | Thomas et al. | 62/613 |
| 6,237,364 | B1 | * | 5/2001 | Stone | 62/613 |

* cited by examiner

*Primary Examiner*—William C. Doerrler
(74) *Attorney, Agent, or Firm*—Gary D. Lawson

(57) ABSTRACT

A process for removing hydrocarbons less volatile than methane from a pressurized liquid natural gas (PLNG). PLNG is heated in a heat exchanger, thereby vaporizing at least a portion of the PLNG. The partially vaporized PLNG is passed to a fractionation column. A liquid stream enriched with hydrocarbons ($C_{2+}$ or $C_{3+}$) less volatile than methane is withdrawn from a lower portion of the fractionation column and a vapor stream lean in the hydrocarbons less volatile than methane is withdrawn from an upper portion of the fractionation column. The withdrawn vapor stream is passed to the heat exchanger to condense the vapor to produce PLNG lean in hydrocarbons less volatile than methane.

9 Claims, 1 Drawing Sheet

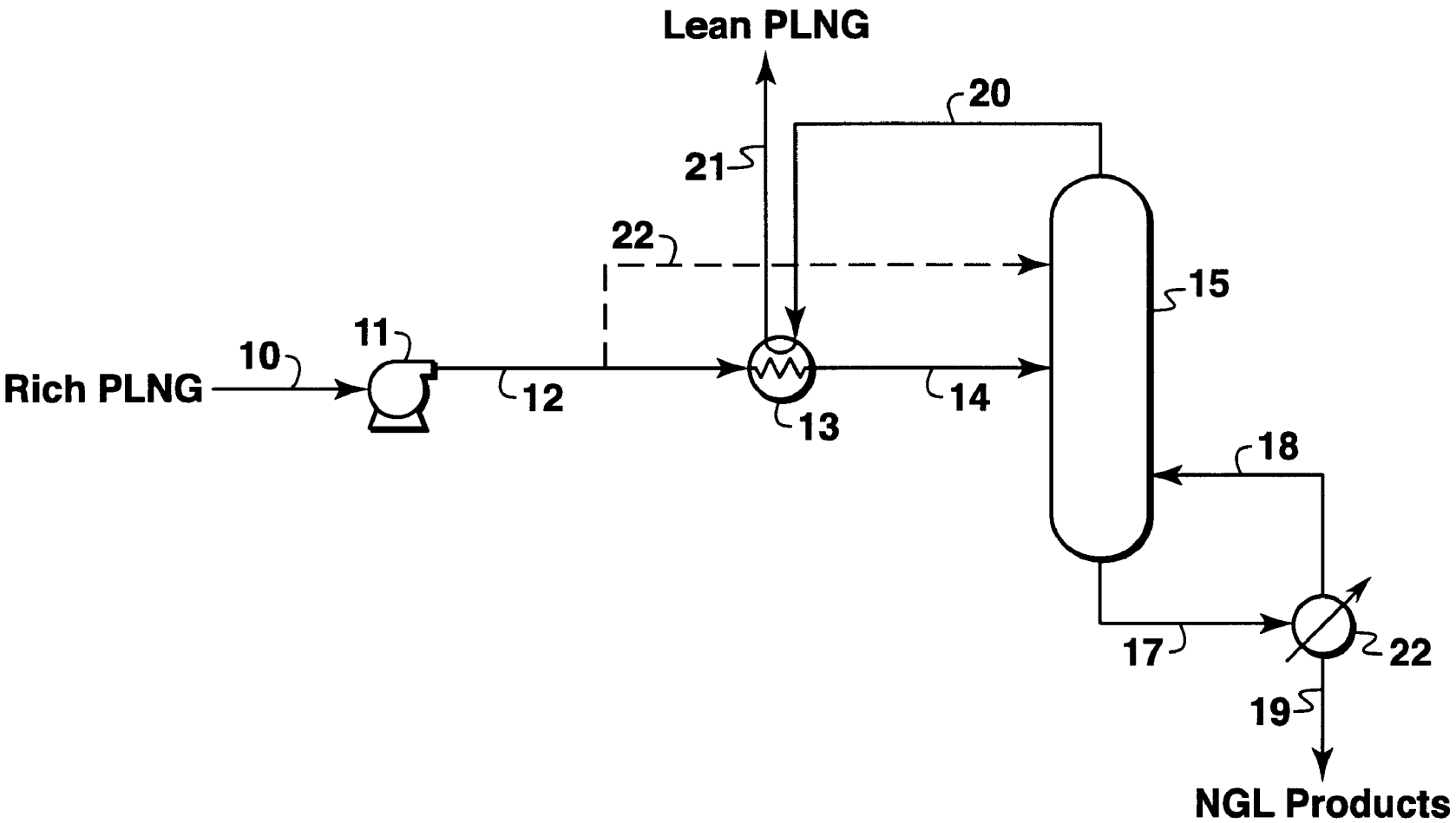
Rich PLNG
10
11
12
22
Lean PLNG
21
20
13
14
15
18
17
22
19
NGL Products

PROCESS FOR NGL RECOVERY FROM PRESSURIZED LIQUID NATURAL GAS

This application claims the benefit of U.S. Provisional Application No. 60/208,200 filed May 31, 2000.

FIELD OF THE INVENTION

The invention relates to a process for recovery of natural gas liquid (NGL) from pressurized liquid natural gas (PLNG).

BACKGROUND OF THE INVENTION

Because of its clean burning qualities and convenience, natural gas has become widely used in recent years. Many sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas (which is called "LNG") for transport to market.

It has been proposed to transport natural gas at temperatures above −112° C. (−170° F.) and at pressures sufficient for the liquid to be at or below its bubble point temperature. This pressurized liquid natural gas is referred to as "PLNG" to distinguish it from LNG, which is transported at near atmospheric pressure and at a temperature of about −162° C. (−260° F.). The term "bubble point" means the temperature and pressure at which a liquid begins to convert to gas. For example, if a certain volume of PLNG is held at constant pressure, but its temperature is increased, the temperature at which bubbles of gas begin to form in the PLNG is the bubble point. Similarly, if a certain volume of PLNG is held at constant temperature but the pressure is reduced, the pressure at which gas begins to form defines the bubble point pressure at that temperature. At the bubble point, the liquefied gas is saturated liquid. For most natural gas compositions, the bubble point pressure of the natural gas at temperatures above −112° C. will be between about 1,380 kPa (200 psia) and about 4,480 kPa (650 psia). Processes for making PLNG are disclosed in U.S. Pat. No. 5,950,453 by R. R. Bowen et al.; U.S. Pat. No. 5,956,971 by E. T. Cole et al.; U.S. Pat. No. 6,016,665 by E. T. Cole et al.; and U.S. Pat. No. 6,023,942 by E. R. Thomas et al.

In conventional LNG plants, essentially all pentanes and heavier hydrocarbons ($C_{5+}$) are typically removed to avoid potential freezing problems at its usual storage temperatures of about −162° C. (−260° F.). One of the advantages of producing and shipping PLNG at a warmer temperature is that PLNG can contain considerably more $C_{5+}$ components than can be tolerated in most LNG applications.

Depending upon market prices for ethane, propane, butanes, and the heavier hydrocarbons (collectively referred to herein as "NGL products"), it may be economically desirable to recover the NGL products from the PLNG and to sell them as separate products. A need therefore exists for a process for effectively removing NGL products from PLNG.

SUMMARY

The invention is a process for removal of hydrocarbons less volatile than methane from a pressurized liquid natural gas (PLNG). In this process PLNG is heated in a heat exchanger, thereby vaporizing at least a portion of the PLNG. The partially vaporized PLNG is passed to a fractionation column. A liquid stream enriched with hydrocarbons ($C_{2+}$ or $C_{3+}$) less volatile than methane is withdrawn from a lower portion of the fractionation column and a vapor stream lean in the hydrocarbons less volatile than methane is withdrawn from an upper portion of the fractionation column. The withdrawn vapor stream is passed to the heat exchanger to condense the vapor to produce PLNG lean in hydrocarbons less volatile than methane.

BRIEF DESCRIPTION OF THE DRAWING

The present invention and its advantages will be better understood by referring to the following detailed description and the attached Drawing which is a flow diagram of a process for removing NGL from PLNG in accordance with the practice of this invention. The Drawing presents a preferred embodiment of practicing the process of this invention. The Drawing is not intended to exclude from the scope of the invention other embodiments that are the result of normal and expected modifications of this specific embodiment.

DETAILED DESCRIPTION OF THE INVENTION

The present invention provides a process for removing NGL products from pressurized liquid natural gas (PLNG) having a temperature above about −112° C. (−1 70° F.) and a pressure sufficient for the liquid product to be at or below its bubble point. PLNG, the feed stock for the process, can be manufactured from any suitable natural gas source by processes such as those disclosed in U.S. Pat. Nos. 6,023,942; 6,016,665; 5,956,971, and 5,950,453. The source gas for making PLNG may comprise gas obtained from a crude oil well (associated gas) or from a gas well (non-associated gas). Although the composition of natural gas can vary significantly, it will contain methane ($C_1$) as a major component. The PLNG will typically also contain ethane ($C_2$), higher hydrocarbons ($C_{3+}$), and minor amounts of contaminants such as carbon dioxide, hydrogen sulfide, nitrogen, dirt, iron sulfide, wax, and crude oil. Liquid $C_{2+}$ hydrocarbons are referred to herein as NGL. The process for removing NGL from the PLNG will now be described with reference to the Drawing.

PLNG feed stream 10 is shown as being passed to a pump 11 to increase the pressure of stream 10. The amount of pressurization will depend primarily on the anticipated pressure losses associated the NGL removal process of this invention, the desired pressure of the fractionation column 15 and the desired pressure of the lean PLNG stream 21. In some applications, the PLNG feed stream 10 may be at a sufficiently high pressure to not need pressurization by pump 11. From pump 11, the PLNG stream 12 is passed through heat exchanger 13 wherein stream 12 provides the required duty for cooling of vapor stream 20 by indirect heat exchange. In passing through heat exchanger 13, at least a portion of stream 12 is vaporized. The partially vaporized stream 14 is passed to one or more fractionation columns where the PLNG undergoes typical distillation. The Drawing shows only one fractionation column 15, which contains trays and/or packing to provide contact between liquids falling downward and vapors rising upward. The lighter, more volatile hydrocarbons leave the upper end of the fractionation column 15 as vapor stream 20 and heavier, less volatile hydrocarbons, leave the lower end of the fractionation column 15 as stream 17. Liquid stream 17 will comprise predominantly natural gas liquids (NGL), primarily ethane, propane, butanes, pentanes, and heavier hydrocarbons. The overhead vapor stream 20 is a lean vapor stream (without significant quantities of C2+) consisting predominantly of methane. Vapor stream 20 is passed through heat exchanger 13 wherein the vapor is reliquefied to produce lean PLNG stream 21.

The liquid stream 17 is warmed in heat exchanger 22 by indirect heat exchange with any suitable heating fluid. Stream 17 is partially vaporized in this heat exchanger. The vaporized portion, stream 18, is returned to the fractionation column 15 to supply the necessary stripping vapors and heating duty to effect the desired hydrocarbon separation. The unvaporized portion of stream 17 is removed from exchanger 22 as the recovered NGL product stream 19. Although not shown in the Drawing, the NGL product stream 19 may be further processed by well known fractionation processes (such as deethanizer, depropanizer, debutanizer, and butane splitter) to separate the NGL into separate products including ethane, propane, iso-butane, n-butane, and pentanes plus.

In some applications, it may be desirable to increase the ethane content of the NGL. In such applications, a portion of stream 12 may optionally be withdrawn and passed as liquid stream 22, shown in the Drawing as a dotted line, directly to the upper portion of the fractionation column 15. The introduction of stream 22 into the fractionation column 15 provides cold reflux to the top section of fractionation column 15 and thereby increases the amount of ethane and/or propane in liquid stream 19.

In conventional LNG manufacturing processes, essentially all of the $C_{5+}$ hydrocarbons are removed from the natural gas before the gas is liquefied to avoid freezing problems. Frequently, propane and butane ($C_3$ and $C_4$ hydrocarbons) are also removed as liquefied petroleum gas (LPG) because the LPG can have a higher economic value and can be transported in more conventional transport carriers. The design of storage tanks for a typical LNG carrier is not affected by the level of LPG components. For PLNG, on the other hand, the amount of $C_{3+}$ present in the PLNG lowers the bubble point pressure, which permits a thinner wall design for PLNG storage tanks. For example, in the Example described below, the bubble point pressure for the particular PLNG composition (see Table 1) is about 6 psi (41 kPa) lower than a PLNG composition that does not contain $C_{3+}$. Depending upon the natural gas composition, the amounts of $C_{3+}$ that could be left with the PLNG for transport to a desired destination could reduce the bubble point pressure by as much as 50 to 60 psia (345 to 414 kPa) for PLNG compositions extremely rich in $C_{3+}$.

Since the practice of the present invention will be used primarily at a PLNG import receiving location, one potential economic benefit from recovering NGL from PLNG in accordance with this invention takes advantage of the cold energy of the transported PLNG. The inventive process does not require external refrigeration or turboexpanders, which makes this NGL removal process significantly less costly than conventional NGL recovery processes that extract and recover ethane and heavier hydrocarbons from natural gas before liquefaction.

EXAMPLE

A hypothetical mass and energy balance was carried out to illustrate the embodiment shown in the Drawing. The data were obtained using a commercially available process simulation program called HYSYS™ (available from Hyprotech Ltd. of Calgary, Canada); however, other commercially available process simulation programs can be used to develop the data, including for example HYSIM™, PROII™, and ASPEN PLUS™, which are familiar to those of ordinary skill in the art. This data assumed the rich PLNG stream 10 had the composition shown in Table 1. Also shown in Table 1 for comparison purposes is the composition of lean PLNG stream 21.

TABLE 1

| Component | Rich PLNG Composition (stream 10) Mole Percent | Lean PLNG Composition (stream 21) Mole Percent |
|---|---|---|
| $C_1$ | 93.82 | 95.02 |
| $C_2$ | 3.73 | 3.78 |
| $C_3$ | 0.28 | 0.10 |
| i-$C_4$ | 0.50 | 0.07 |
| n-$C_4$ | 0.15 | 0.01 |
| $C_{5+}$ | 0.53 | 0.01 |
| $CO_2$ | 0.95 | 0.96 |
| $N_2$ | 0.04 | 0.05 |

The results of the simulation are shown in Table 2. The data presented in Table 2 are offered to provide a better understanding of the embodiment shown in the Drawing, but the invention is not to be construed as unnecessarily limited thereto. The temperatures, pressures, compositions, and flow rates can have many variations in view of the teachings herein. One advantage of the process of this invention is the ability to remove NGL from rich PLNG to produce a lean PLNG without external refrigeration. However, one skilled in the art will recognized that external refrigeration could be added to the process to assist in condensing vapor stream 20.

TABLE 2

| Stream | Temperature | | Pressure | | Flowrate | |
|---|---|---|---|---|---|---|
| # | ° C. | ° F. | KPa | psia | kgmol/hr | mmscfd |
| 10 | −95.0 | −139.0 | 2861 | 415 | 37680 | 756.5 |
| 12 | −94.2 | −137.6 | 3378 | 490 | 37680 | 756.5 |
| 14 | −74.0 | −101.2 | 3309 | 480 | 37680 | 756.5 |
| 17 | 141.5 | 286.7 | 3365 | 488 | 4050 | 81.3 |
| 19 | 151.7 | 305.1 | 3330 | 483 | 477 | 9.6 |
| 20 | −70.9 | −95.6 | 3309 | 480 | 37203 | 746.9 |
| 21 | −91.5 | −132.7 | 3241 | 470 | 37203 | 746.9 |

A person skilled in the art, particularly one having the benefit of the teachings of this patent, will recognize many modifications and variations to the specific embodiment disclosed above. For example, a variety of temperatures and pressures may be used in accordance with the invention, depending on the overall design of the system, the desired component recoveries and the composition of the PLNG. Additionally, certain process steps may be accomplished by adding devices that are interchangeable with the devices shown. As discussed above, the specifically disclosed embodiment and example should not be used to limit or restrict the scope of the invention, which is to be determined by the claims below and their equivalents.

What is claimed is:

1. A process for removing hydrocarbons less volatile than methane from a pressurized liquid natural gas (PLNG), comprising the steps of:

(a) heating the PLNG in a heat exchanger, thereby vaporizing at least a portion of the PLNG;

(b) passing the partially vaporized PLNG to a fractionation column;

(c) withdrawing a liquid stream enriched with hydrocarbons less volatile than methane from a lower portion of the fractionation column;

(d) withdrawing a vapor stream from an upper portion of the fractionation column; and (e) passing the vapor stream to the heat exchanger to condense the vapor to produce PLNG lean in hydrocarbons less volatile than methane.

2. The process of claim 1 further comprising, before step (a), the additional step of withdrawing a portion of PLNG and passing the withdrawn portion to the fractionation column to provide liquid reflux for the fractionation column.

3. The process of claim 1 further comprising the additional step of heating the withdrawn liquid stream of step (c) and returning the vaporized portion of the heated withdrawn liquid stream to the fractionation column for reboiler duty.

4. The process of claim 1 wherein the PLNG before being heated in step (a) has a temperature above about −112° C. (−170° F.) and a pressure sufficient for the liquid product to be at or below its bubble point.

5. The process of claim 1 wherein the lean PLNG of step (e) has a temperature above about −112° C. (−170° F.) and a pressure sufficient for the liquid product to be at or below its bubble point.

6. A process for conveying natural gas containing $C_{3+}$ hydrocarbons, comprising the steps of:

(a) liquefying a natural gas stream to produce pressurized liquid natural gas (PLNG) containing $C_{3+}$ hydrocarbons and having a temperature above −112° C. (−170° F.) and a pressure sufficient for the PLNG to be at or below its bubble point;

(b) transporting the PLNG in one or more suitably pressurized containers onboard a floating vessel;

(c) removing the PLNG from at least one of the containers and heating the PLNG in at least one heat exchanger, thereby vaporizing at least a portion of the PLNG;

(d) passing the partially vaporized PLNG to a fractionation system;

(e) withdrawing a liquid stream enriched with $C_{3+}$ from a lower portion of the fractionation system;

(f) withdrawing a vapor from an upper portion of the fractionation system;

(g) cooling the vapor and thereby condensing the vapor to produce PLNG lean in $C_{3+}$;

(h) further conveying the PLNG of step (g); and (i) heating the PLNG of step (h) to convert the PLNG to natural gas lean in $C_{3+}$.

7. A process for removal of $C_{2+}$ or $C_{3+}$ hydrocarbons from a pressurized liquid natural gas (PLNG), comprising the steps of:

(a) heating the PLNG in a heat exchanger, thereby vaporizing at least a portion of the PLNG;

(b) passing the partially vaporized PLNG to a fractionation column;

(c) withdrawing a liquid stream enriched with $C_{2+}$ or $C_{3+}$ from a lower portion of the fractionation column;

(d) withdrawing a vapor stream from an upper portion of the fractionation column; and (e) passing the vapor stream to the heat exchanger to condense the vapor to produce PLNG lean in $C_{2+}$ or $C_{3+}$.

8. The process of claim 1 wherein the removal of hydrocarbons less volatile than methane from a pressurized liquid natural gas (PLNG) is performed without external refrigeration.

9. The process of claim 1 wherein the removal of hydrocarbons less volatile than methane from a pressurized liquid natural gas (PLNG) is performed without expansion cooling.

* * * * *